US011604043B2

(12) United States Patent
Wifler

(10) Patent No.: US 11,604,043 B2
(45) Date of Patent: Mar. 14, 2023

(54) METHODS FOR HYDROPHOBIZING BOWSTRINGS

(71) Applicant: WIFLER INDUSTRIES LLC, Crete, IL (US)

(72) Inventor: Alex Wifler, Crete, IL (US)

(73) Assignee: WIFLER INDUSTRIES LLC, Crete, IL (US)

( * ) Notice: Subject to any disclaimer, the term of this patent is extended or adjusted under 35 U.S.C. 154(b) by 0 days.

(21) Appl. No.: 17/351,687

(22) Filed: Jun. 18, 2021

(65) Prior Publication Data

US 2022/0404117 A1 Dec. 22, 2022

(51) Int. Cl.

| | |
|---|---|
| ***B05D 1/02*** | (2006.01) |
| ***F41B 5/14*** | (2006.01) |
| ***B05D 7/02*** | (2006.01) |
| ***B05D 5/08*** | (2006.01) |

(52) U.S. Cl.

CPC ..... *F41B 5/1411* (2013.01); *B05D 1/02* (2013.01); *B05D 5/08* (2013.01); *B05D 7/02* (2013.01); *B05D 2401/10* (2013.01); *B05D 2518/12* (2013.01)

(58) Field of Classification Search

CPC ..... B05D 1/02; B05D 5/08

See application file for complete search history.

(56) References Cited

U.S. PATENT DOCUMENTS

2014/0083401 A1* 3/2014 Armstrong ..... F41B 5/1403 124/88

2016/0025444 A1* 1/2016 Griggs ..... F41B 5/1411 124/90

OTHER PUBLICATIONS

Legend Archery Blog, (https://legendarchery.com/blogs/archery-bowhunting-blog/15724912-the-details-you-need-to-know-about-your-bowstring) 2018 (Year: 2018).*

* cited by examiner

*Primary Examiner* — Nathan T Leong

(74) *Attorney, Agent, or Firm* — Saul Ewing LLP

(57) ABSTRACT

Methods for hydrophobizing bowstrings are described herein. In one aspect, the method can include applying a silicone-based hydrophobic coating to the bowstring; and curing the bowstring for a predefined period of time.

5 Claims, 4 Drawing Sheets

METHODS FOR HYDROPHOBIZING BOWSTRINGS

BACKGROUND OF THE INVENTION

Bowstrings for bows are typically composed of water-absorbing materials. For example, conventional bowstrings are typically made of Dacron fibers, Kevlar fibers, Vectran fibers, Spectra fibers, Dyneema fibers, or a combination thereof. However, these fibers are naturally water-absorbent. When waterlogged, the characteristics of the bowstrings can be altered. For example, the weight of the bowstring increases with water absorption, the elasticity of the bowstring can decrease with water absorption, and the like.

The conventional technique for mitigating water absorption of a bowstring is to place a volume of wax onto the bowstring. However, the wax creates a semi-permanent coating, which can wipe off of the string over time. Likewise, the wax can be messy not only to place on the string itself, but also in using the bowstring when the wax is on the surface.

Extensive experimentation has been performed to identify hydrophobic coatings. For example, various oils, beeswax, various other waxes, baby powder, argon oil, to name a few, have been tested for hydrophobizing bowstrings. However, none of the above-mentioned compositions have successfully hydrophobized a bowstring.

SUMMARY

Methods for hydrophobizing bowstrings are described herein. In one aspect, the method can include applying a silicone-based hydrophobic coating to the bowstring; and curing the bowstring for a predefined period of time.

This aspect can include a variety of embodiments. In one embodiment, applying the silicone-based hydrophobic coating further includes spraying the silicone-based hydrophobic coating onto the bowstring.

In another embodiment, the silicone-based hydrophobic coating includes silicone dioxide nanoparticles. In some cases, the silicone-based hydrophobic coating further includes an alcohol solution.

In another embodiment, the predefined period of time can be 10 seconds.

In another embodiment, the bowstring is composed of poly-para-phenylene terephthalamide (Kevlar), Polyethylene terephthalate (Dacron), or a combination thereof.

In another embodiment, the silicone-based hydrophobic coating can be a car coating spray.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

Methods for hydrophobizing bowstrings are described herein. The method can include applying a hydrophobizing coating to the bowstring. The hydrophobizing coating can be a car coating spray that includes a silicon nanoparticles. The spray can bond with the composition of the bowstring after a curing period, which can hydrophobize the bowstring. Thus, the spray can last significantly longer than conventional waxes, and does not significantly affect the weight of the bowstring.

The hydrophobic coating can be composed of silicone nanoparticles. In some cases, the coating can also be composed of an alcoholic solution. In particular, an embodiment of the hydrophobic coating can be the ZXL-Rain spray. However, other hydrophobic, silicone-based coatings for automobiles can be used as well, such as Chemical Guys HydroSlick SiO2 Ceramic Coating Hyperwax, Nasiol ZR53, The Last Coat Black Ice Ceramic Coating, CarPro CQuartz UK 3.0, and the like.

Figure 1:
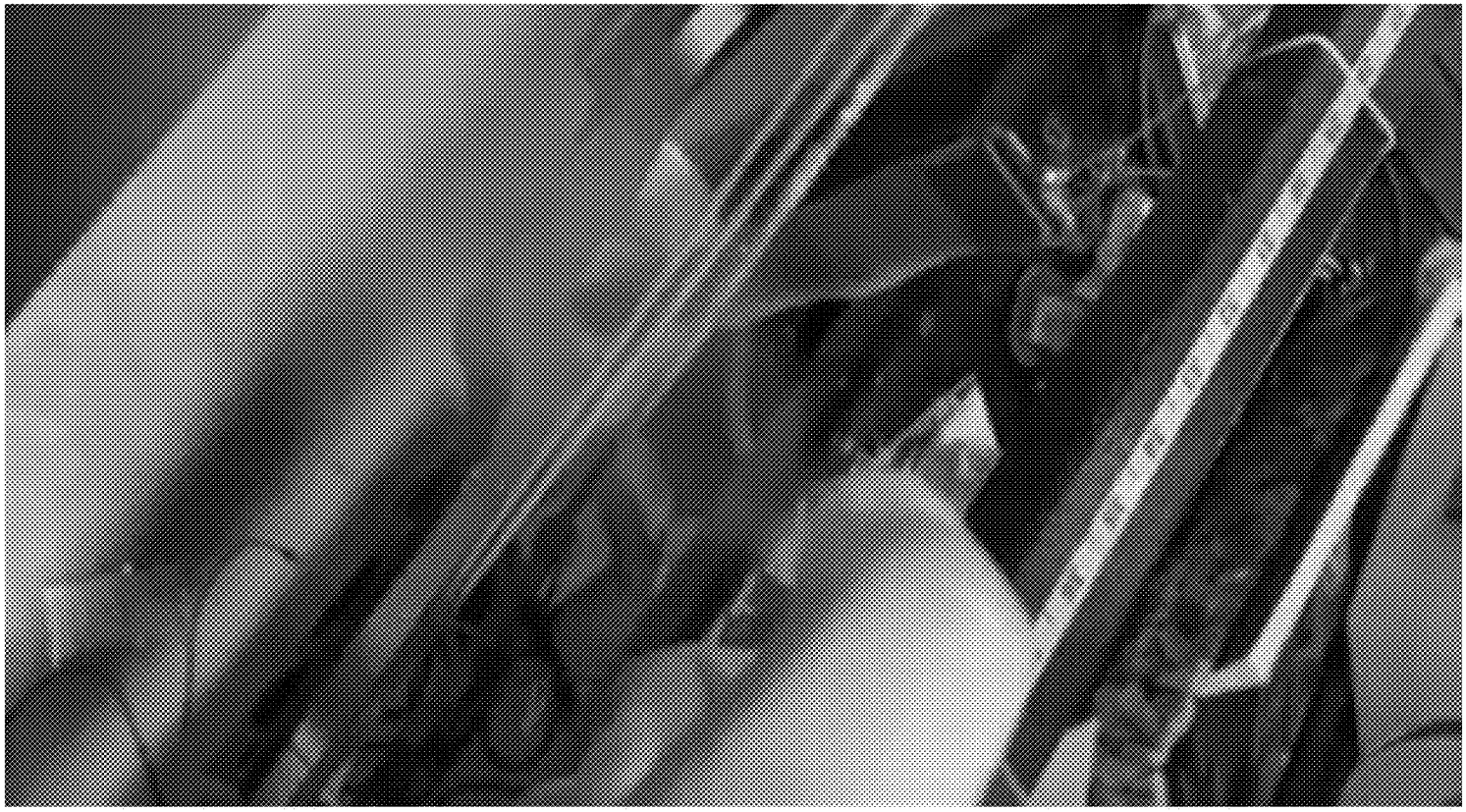
FIG. 1 depicts an image of applying a hydrophobizing coating according to an embodiment of the present disclosure.

FIG. 1 depicts an image of applying a hydrophobizing coating according to an embodiment of the present disclosure. The coating can be in liquid form, and can be sprayed onto the bowstring. The image of FIG. 1 depicts a user spraying the coating onto the surface of the bowstring. The bowstring can be stretched for ease of the coating application (e.g., the bowstring is coupled to a bow prior to application). In some cases, the bowstring can be stretched in a horizontal fashion, or in a vertical fashion, for applying the coating. In some cases, the coating can be sprayed a sufficient number of times to cover the surface of the bowstring, for example, 10 pumps of the spray. In some cases, the coating can be wiped along the length of the bowstring (e.g., with a towel or a user's finger). In some cases, the spray can be a distance away from the bowstring for sufficient coverage of the bowstring when sprayed (e.g., 6 inches away, 12 inches away, and the like). Further, the coating can be applied across the entire surface of the bowstring for sufficient coverage.

Figure 2:
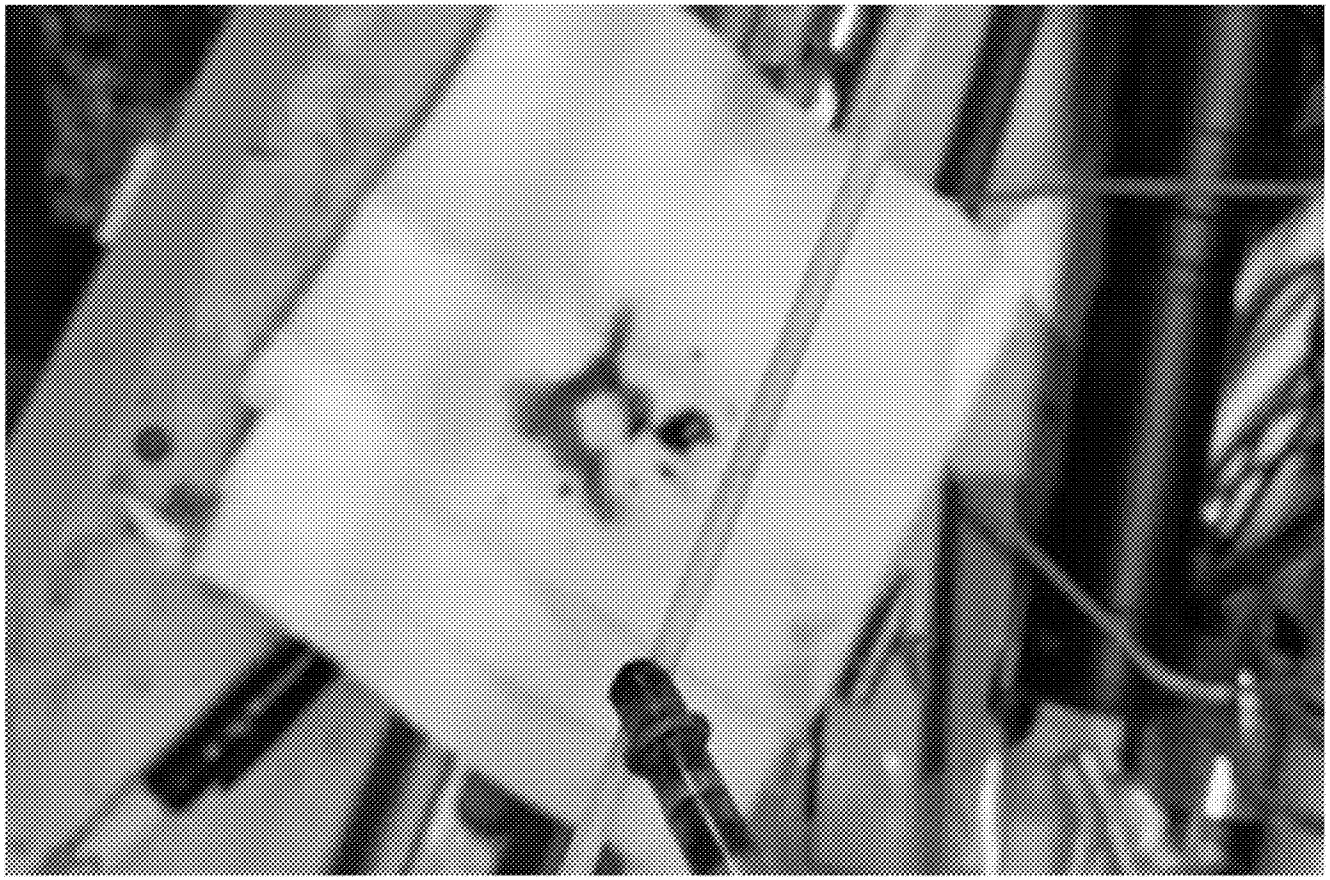
FIG. 2 depicts an image of liquid being placed onto the bowstring after hydrophobizing the bowstring, according to an embodiment of the present disclosure.
Figure 3:
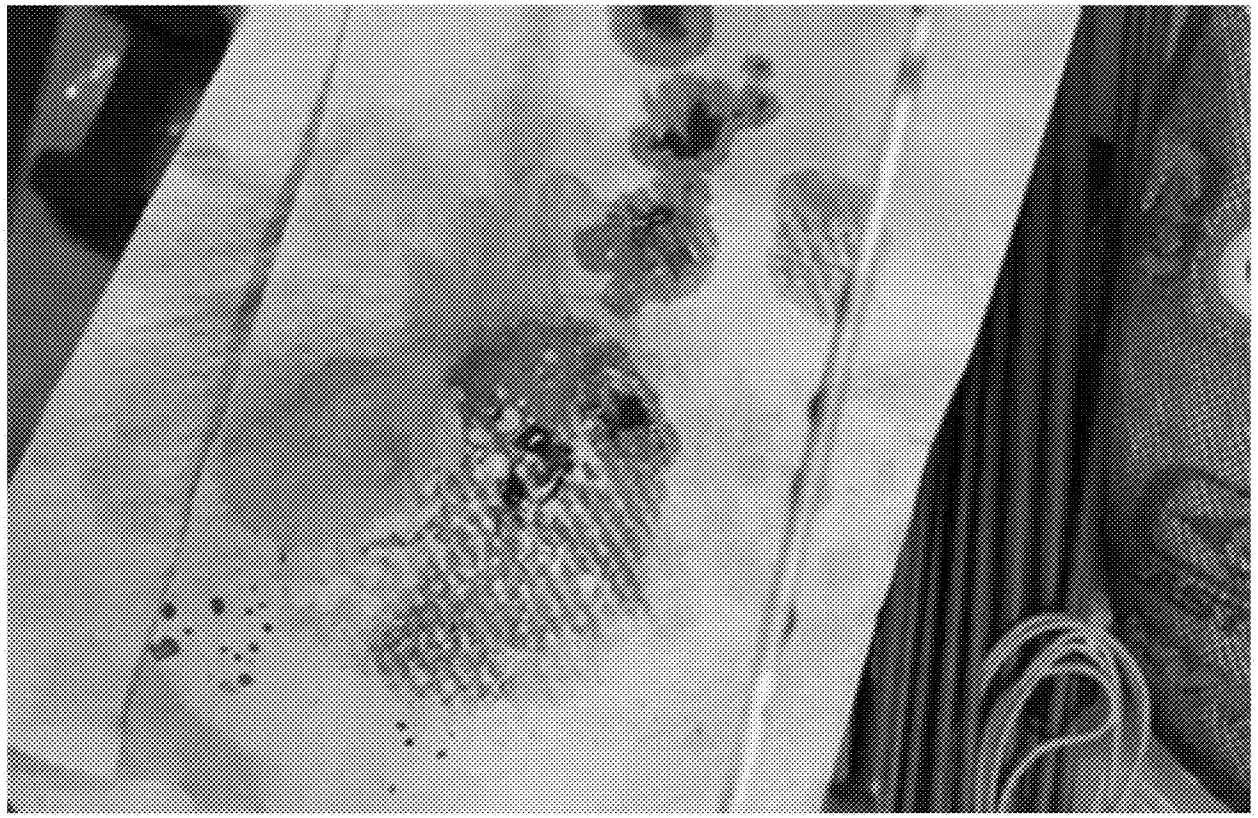
FIG. 3 depicts an image of liquid being placed on an un-hydrophobized portion of a bowstring.

FIG. 2 depicts an image of liquid being placed onto the bowstring after hydrophobizing the bowstring. After a curing period subsequent to the application of the coating, the coating can form a semi-permanent bond with the bowstring surface. In some cases, the curing period can be a sufficient amount of time for the coating to cover the surface of the bowstring (e.g., 5 seconds, 10 seconds, 30 seconds, 1 minute, and the like). In other cases, the curing time can be a sufficient amount of time for the coating to dry on the surface of the bowstring (e.g., 1 minute, 2 minutes, and the like). In some cases, the bowstring can be isolated from contacting surfaces during the curing time, so as to not smear or remove the coating from the surface of the bowstring. FIG. 2 depicts an image of liquid being placed on a hydrophobized bowstring according the methods described herein. As can be seen, the liquid does not absorb into the bowstring, and instead wicks off the bowstring surface. FIG. 3 depicts an image of liquid being placed on an un-hydrophobized portion of a bowstring. As shown in FIG. 3, the liquid becomes partially absorbed into the bowstring.

Figure 4:
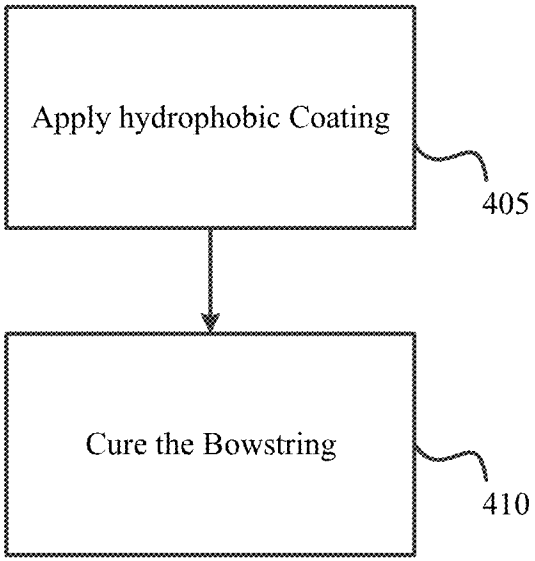
FIG. 4 depicts a process flow for hydrophobizing a bowstring, according to an embodiment of the present disclosure.

FIG. 4 depicts a process flow for hydrophobizing a bowstring, according to an embodiment of the present disclosure.

At Step 405, a silicone-based hydrophobic coating can be applied to the bowstring. In some cases, the bowstring can be composed of Dacron fibers, Kevlar fibers, Vectran fibers, Spectra fibers, Dyneema fibers, or a combination thereof. In some cases, the silicone-based hydrophobic coating can be composed of silicone nanoparticles, silicone dioxide nanoparticles, or a combination thereof. In some cases, the silicone-based hydrophobic coating can also include a volume of alcohol. In some cases, silicone-based hydrophobic coating can be in spray form. In some cases, the silicone-based hydrophobic coating can be a car coating spray. For example, the silicone-based hydrophobic coating can be ZXL-Rain spray.

At Step 410, the bowstring can be cured for a predefined period of time. In some cases, the predefined period of time can be 10 seconds. In some cases, the predefined period of time can be 1 minute. In some cases, the predefined period of time can be 5 minutes.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A method for hydrophobizing a bowstring comprising:

applying a silicone-based hydrophobic coating to the bowstring; and curing the bowstring for a predefined period of time, wherein the silicone-based hydrophobic coating comprises silicone dioxide nanoparticles.

2. The method of claim 1, wherein applying the silicone-based hydrophobic coating further comprises spraying the silicone-based hydrophobic coating onto the bowstring.

3. The method of claim 1, wherein the silicone-based hydrophobic coating further comprises an alcohol solution.

4. The method of claim 1, wherein the predefined period of time comprises 10 or more seconds.

5. The method of claim 1, wherein the bowstring is composed of poly-para-phenylene terephthalamide (Kevlar), Polyethylene terephthalate (Dacron), or a combination thereof.

* * * * *